US006443778B1

(12) United States Patent
Koch

(10) Patent No.: US 6,443,778 B1
(45) Date of Patent: Sep. 3, 2002

(54) ELECTRICAL CONNECTOR ASSEMBLY

(75) Inventor: Richard M. Koch, Wakefield, MA (US)

(73) Assignee: Tru-Connector Corporation, Peabody, MA (US)

( * ) Notice: Subject to any disclaimer, the term of this patent is extended or adjusted under 35 U.S.C. 154(b) by 0 days.

(21) Appl. No.: 09/919,099

(22) Filed: Jul. 31, 2001

Related U.S. Application Data

(60) Provisional application No. 60/221,744, filed on Jul. 31, 2000.

(51) Int. Cl.[7] ..... H01R 13/64
(52) U.S. Cl. ..... 439/680; 439/320
(58) Field of Search ..... 439/680, 681, 439/320, 321, 322, 323, 312, 307, 308, 309, 313–319, 310, 311, 306

(56) References Cited

U.S. PATENT DOCUMENTS

| | | | | |
|---|---|---|---|---|
| 3,194,588 A | | 7/1965 | Buckey et al. | 285/18 |
| 3,848,950 A | | 11/1974 | McCormick et al. | 339/90 R |
| 3,980,373 A | | 9/1976 | McCormick et al. | 339/45 M |
| 4,111,514 A | | 9/1978 | Brishka et al. | 339/186 R |
| 4,183,605 A | | 1/1980 | Arneson | 339/89 |
| 4,477,140 A | * | 10/1984 | Espiritu | 439/312 |
| 4,801,277 A | | 1/1989 | Seilhan | 439/680 |
| 5,127,843 A | | 7/1992 | Henry et al. | 439/320 |
| 5,211,574 A | * | 5/1993 | Van Wyck | 439/378 |
| 5,413,502 A | * | 5/1995 | Wang | 439/551 |
| 5,662,488 A | * | 9/1997 | Alden | 439/314 |

* cited by examiner

*Primary Examiner*—P. Austin Bradley
*Assistant Examiner*—Ross Gushi
(74) *Attorney, Agent, or Firm*—Grossman, Tucker, Perreault & Pfleger, PLLC

(57) ABSTRACT

An electrical connector assembly including a plug portion and a receptacle portion. The plug portion includes a coupling nut and a key. The key includes a projection and a flat surface, and is free to rotate relative to the coupling nut. The receptacle portion includes a flat surface and raceway for receiving the projection to allow threaded mating of the receptacle and plug portions.

8 Claims, 2 Drawing Sheets

ELECTRICAL CONNECTOR ASSEMBLY

CROSS REFERENCE TO RELATED APPLICATIONS

The present application claims the benefit of U.S. Provisional application Ser. No. 60/221,744, filed Jul. 31, 2000, the teachings of which are incorporated herein by reference.

FIELD OF THE INVENTION

The present invention relates in general to electrical connectors, and in particular to an electrical connector assembly having keyed components for preventing inadvertent connection of a plug with an incorrect receptacle.

BACKGROUND

Whenever two or more plug and receptacle pairs, each comprising the subassemblies of a connector arrangement, are located adjacent to each other, there is always the possibility that the various connector plugs may not be mated to the receptacles for which they were intended, through human error. This is particularly true where these connections are located in difficult access positions. If the connectors are of the single cable coaxial type, for example, there is nothing about the connector subassemblies (plug and receptacle halves) themselves that would prevent mismating, since the corresponding subassemblies are frequently identical parts.

Although some coaxial connectors are "polarized", these are limited to situations where there are just two coaxial connections to be considered at any one location. Even in multi-pin connectors, any "keying" provided is usually for rational alignment purposes and cannot prevent the inadvertent mismating of identical plug and receptacle connector subassemblies.

There is, therefore, a need in the art for electrical connectors that are configured to efficiently and reliably prevent inadvertent connections of a plug into an incorrect receptacle.

SUMMARY OF THE INVENTION

A connector assembly consistent with the invention includes a plug portion and a receptacle portion. The plug portion includes a coupling nut and a separate key rotatably secured to an interior surface of the coupling nut. The key includes a first flat surface and a projection that extends from an interior surface of the key. The receptacle portion includes an outer shell and threads for meshingly engaging corresponding threads on the plug upon mating of the plug to the receptacle. The outer shell includes a second flat surface and a raceway. The second flat surface is positioned to align with the first flat surface, and the raceway is dimensioned to receive the projection. The projection is maintained in the raceway upon mating of the plug with the receptacle through meshing engagement of the threads on the receptacle with the threads on the plug.

BRIEF DESCRIPTION OF THE DRAWING

For a better understanding of the present invention, together with other objects, features and advantages, reference should be made to the following detailed description which should be read in conjunction with the following figures wherein like numerals represent like parts.

DETAILED DESCRIPTION

The present invention will now be described in connection with an exemplary embodiment wherein the receptacle is adapted to mount to an instrument panel, or the like. Those skilled in the art will recognize, however, that the advantages of the invention could be incorporated into many connector designs. It is intended, therefore, that the invention not be limited to the specific embodiment described, but include any variation thereof associated with use in varied connector schemes and designs.

In general, the present invention relates to a connector assembly including keyed plug and receptacle portions. The plug includes a retractable coupling nut and a key that rotates relative to the coupling nut to allow threaded connection between the plug and the receptacle. The receptacle is configured to receive the key to prevent inadvertent connection of an incorrect plug with the receptacle.

Figure 1:
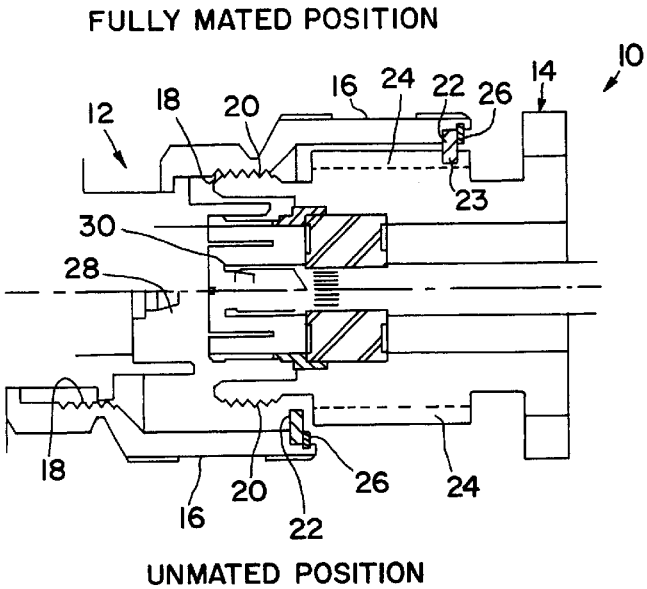
FIG. 1 is a partial sectional view of an exemplary connector assembly consistent with the invention wherein the top portion illustrates an exemplary plug and receptacle consistent with the invention in a mated position and the bottom portion illustrates the plug and receptacle in an unmated position.

Turning to FIG. 1, a partial sectional view of an exemplary connector assembly 10 consistent with the invention is illustrated, wherein the top portion illustrates an exemplary plug 12 and receptacle 14 consistent with the invention in a mated position and the bottom portion illustrates the plug 12 and receptacle 14 in an unmated position. In the illustrated exemplary embodiment, the plug portion includes a retractable coupling nut 16, which moves axially against the bias of a spring (not shown). In the top portion of FIG. 1, the coupling nut is shown in an extended position, and in the bottom portion of FIG. 1, the coupling nut is shown in a retracted position.

In the illustrated exemplary embodiment, the coupling nut 16 includes internal threads 18 for meshingly engaging corresponding exterior threads 20 on the receptacle portion. The plug also includes a key 22, which includes a projection 23 that mates with a corresponding raceway 24 in the receptacle to ensure that a plug is mated with an appropriate receptacle. In the illustrated embodiment, the key 22 is held in place on the end of the coupling nut 16 by a retainer ring 26, but is free to rotate relative to the coupling nut 16.

Figure 6:
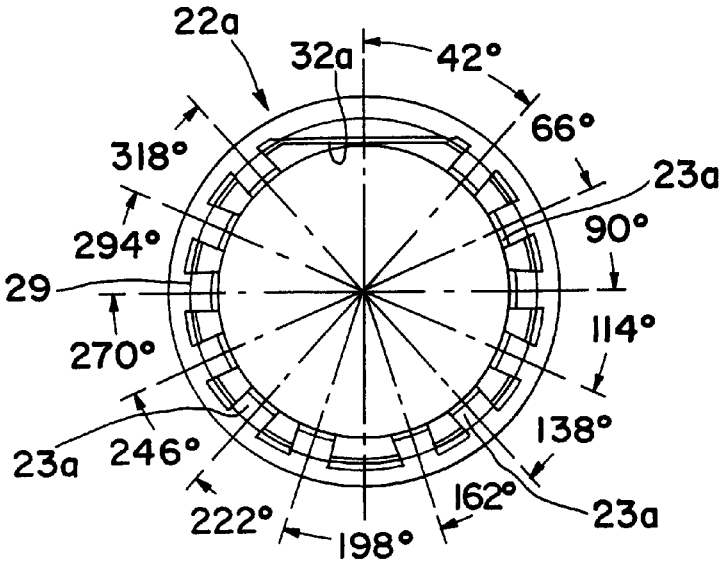
FIG. 6 is an end view of a key consistent with the invention illustrating alternative key positions.

Electrical connection between a center pin 28 on the plug and a center conductor 30 on the receptacle may be established and maintained by forcing the coupling nut axially outward in the direction of the receptacle 14 and mating projection 23 of the key 22 with the raceway 24 on the receptacle. The interior surface of the key 22 also includes a flat portion 32. The flat portion 32, as shown in FIG. 3, is aligned with a corresponding flat portion 34 of an exterior surface of an outer shell 37 of the receptacle, as shown in FIG. 6.

The plug is threaded onto the receptacle via threads 18 and 20. Mounting of the key 22 to the coupling nut to allow relative rotational movement therebetween allows the projection 23 to remain in the raceway 24 and the flat surface 32 of the key to remain aligned with the flat surface 34 on the receptacle as the coupling nut rotates onto the receptacle with meshing engagement of the threads. To remove the connection, the coupling nut 16 is rotated in an opposite direction, while the key 22 remains in the raceway 24, until the threads 18 on the coupling nut disengage from the threads 20 on the receptacle. Then, the coupling nut may move rearward with the key 22 traveling axially in the raceway 24 until it is withdrawn therefrom.

Figure 2:
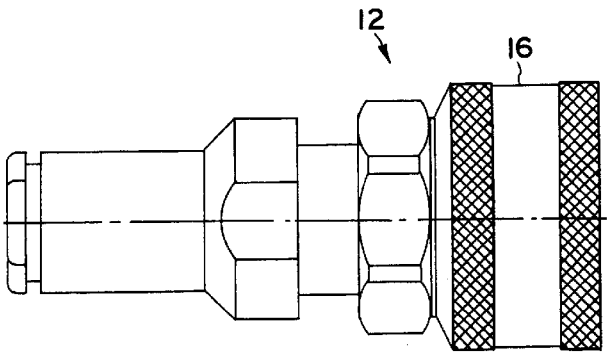
FIG. 2 is a side view of the exemplary plug illustrated in FIG. 1.
Figure 3:
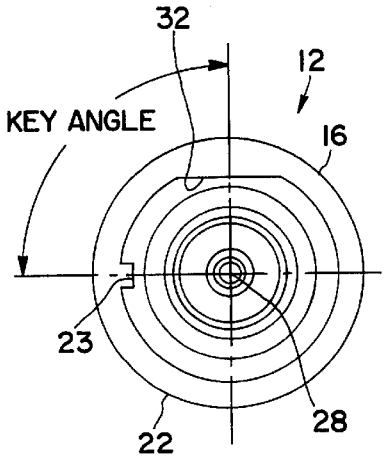
FIG. 3 is an end view of the exemplary plug illustrated in FIG. 1.
Figure 4:
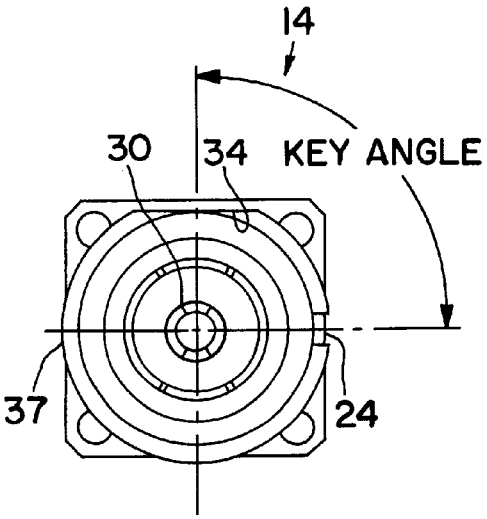
FIG. 4 is an end view of the exemplary receptacle illustrated in FIG. 1.
Figure 5:
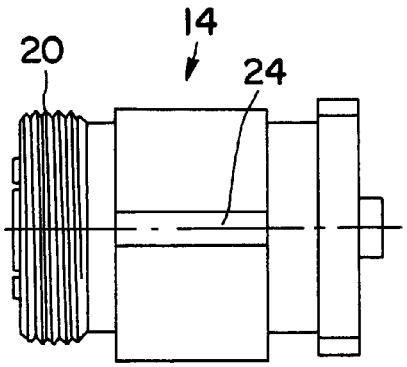
FIG. 5 is a side view of the exemplary receptacle illustrated in FIG. 1.

An exemplary plug consistent with the invention is illustrated in FIGS. 2 and 3, and an exemplary receptacle consistent with the invention is illustrated in FIGS. 4–5 As shown in FIG. 3, the flat surface 32 and the projection 23 of the key 22 define a key angle, measured in this instance from the center of the flat surface 32 to the key 22. The key angle for the plug 12 is configured to match a corresponding key angle for the receptacle.

In the exemplary embodiment illustrated in FIG. 5, the flat surface 34 on the receptacle is formed on the exterior surface of the outer shell 37. Also, the keyway for receiving the projection 23 is configured as a groove in the outer shell 37. The receptacle key angle is measured from the center of the flat surface 34 on the receptacle to the center of the raceway 24.

Although in the illustrated exemplary embodiment the projection 23 and the keyway 24 are generally rectangular in cross-section, those skilled in the art will recognize that these elements may be configured in any regular or irregular geometric shape and/or multiple keys and associated keyways may be provided. Also, the keyway need not have the same cross-sectional shape as the projection. In regard to the flat surfaces 32 and 34, the illustrated embodiment depicts only a single flat surface. It is possible, however, to provide non-flat surfaces and/or multiple flat surfaces or non-flat surfaces.

Advantageously, a variety of matching key angles for the plug and receptacle are possible. FIG. 4, for example, is an end view of a key 22*a* consistent with the invention illustrating alternative key angle positions. Each of the alternative key angle positions is measured from the flat surface 32*a* to an associated one or ones of the projections 23*a*. The key angle or angles for the key 22*a* would be established by removing material in the key, e.g. to line 29, to leave a selected one or ones of the projections 23*a* extending radially inward. The corresponding receptacle would be provided with a flat surface positioned to align with the flat surface 32*a* and a number of raceways 24 each of which configured to mate with an associated one of the projections 23*a*.

There is thus provided a connector assembly including a plug and receptacle that are keyed to one another to prevent inadvertent connection of a plug with an incorrect receptacle, which could cause damage to associated equipment. Consistent with the invention a retractable coupling nut is provided on the plug and threaded engagement of the plug to the receptacle is achieved with a key projection on a rotatable key maintained in a corresponding raceway in the receptacle. The key projection therefore maintains its position in the raceway during mating of the plug to the receptacle to allow facile withdrawal of the key from the raceway when connection between the plug and receptacle is removed.

The embodiments that have been described herein, however, are but some of the several which utilize this invention and are set forth here by way of illustration but not of limitation. It is obvious that many other embodiments, which will be readily apparent to those skilled in the art, may be made without departing materially from the spirit and scope of this invention.

What is claimed is:

1. A connector assembly comprising:

a plug comprising a coupling nut and a separate key rotatably secured to an interior surface of the coupling nut, said key comprising a first flat surface and a projection, said projection extending from an interior surface of said key; and a receptacle comprising an outer shell and threads for meshingly engaging corresponding threads on said plug upon mating of said plug to said receptacle, said outer shell comprising a second flat surface and a raceway, said second flat surface being positioned to align with said first flat surface and said raceway being dimensioned to receive said projection, whereby said projection is maintained in said raceway upon mating of said plug with said receptacle through meshing engagement of said threads on said receptacle with said threads on said plug.

2. The connector assembly of claim 1, wherein said key is secured to said coupling nut by a retainer ring.

3. The connector assembly of claim 1, wherein said projection is generally rectangular in shape.

4. The connector assembly of claim 1, wherein said raceway is generally rectangular in shape.

5. The connector assembly of claim 1, wherein said coupling nut is retractable.

6. The connector assembly of claim 1 wherein said threads on said plug are disposed on an interior surface of said coupling nut.

7. The connector assembly of claim 6, wherein said threads on said receptacle are disposed on an exterior surface of said receptacle.

8. A plug portion of a connector assembly, said plug portion comprising:

a retractable coupling nut and a separate key secured to an interior surface of the coupling nut, said key comprising a flat surface and a projection, said projection extending from an interior surface of said key for entering a corresponding raceway on a receptacle portion of said assembly, said key being rotatable relative to said coupling nut allowing said projection to remain in said raceway upon threaded mating of said plug to the receptacle portion.

* * * * *